US007198054B2

(12) United States Patent
Welch

(10) Patent No.: US 7,198,054 B2
(45) Date of Patent: Apr. 3, 2007

(54) DISHWASHER HAVING A SIDE-BY-SIDE RACK SYSTEM

(75) Inventor: Rodney M. Welch, Jackson, TN (US)

(73) Assignee: Maytag Corporation, Newton, IA (US)

( * ) Notice: Subject to any disclaimer, the term of this patent is extended or adjusted under 35 U.S.C. 154(b) by 350 days.

(21) Appl. No.: 10/736,518

(22) Filed: Dec. 17, 2003

(65) Prior Publication Data

US 2005/0133063 A1 Jun. 23, 2005

(51) Int. Cl.
*B08B 3/02* (2006.01)

(52) U.S. Cl. ..... 134/57 D; 134/56 D; 134/58 D; 134/200; 134/201; 134/228; 134/94.1; 134/135

(58) Field of Classification Search ..... 134/57 D, 134/56 D, 200, 201, 228, 58 D, 94.1, 135
See application file for complete search history.

(56) References Cited

U.S. PATENT DOCUMENTS

| | | | | |
|---|---|---|---|---|
| 2,710,617 | A | 6/1955 | James et al. | |
| 2,947,311 | A | 8/1960 | Fox et al. | |
| 3,095,885 | A | 7/1963 | Hertell | |
| 3,141,618 | A | 7/1964 | Haas | |
| 3,217,721 | A | 11/1965 | Hertel | |
| 3,221,754 | A | 12/1965 | Robson et al. | |
| 3,329,529 | A | 7/1967 | Lamar | |
| 3,466,109 | A | 9/1969 | Kauffman et al. | |
| 3,486,804 | A | 12/1969 | Kaufman et al. | |
| 3,586,011 | A * | 6/1971 | Mazza | 134/57 D |
| 3,594,058 | A | 7/1971 | Kauffman | |
| 3,884,263 | A | 5/1975 | Wright | |
| 4,134,413 | A | 1/1979 | Noren | |
| 4,653,520 | A | 3/1987 | Alvemarker | |
| 5,829,459 | A | 11/1998 | Milocco et al. | |
| 5,934,298 | A | 8/1999 | Singh | |
| 6,289,908 | B1 | 9/2001 | Kelsey | |

* cited by examiner

*Primary Examiner*—Zeinab El-Arini
(74) *Attorney, Agent, or Firm*—Diederiks & Whitelaw PLC

(57) ABSTRACT

A dishwasher includes a cabinet having arranged therein a central cavity. Slidably supported within the second cavity are first and second dish support rack systems. The first dish support rack system is defined by first and second upper dish support racks with the first upper dish support rack having a first width and the second dish support rack having a second width, substantially smaller than the first width. The second dish support rack system includes first and second lower dish support racks, each being substantially similar in construction to the first and second upper dish support racks. The dishwasher includes a first wash zone defined by the first upper and lower racks and a second wash zone defined by the second upper and lower racks. A control can selectively direct pressurized wash water through an associated spray arm member to the first and second wash zones either singly or collectively.

25 Claims, 4 Drawing Sheets

DISHWASHER HAVING A SIDE-BY-SIDE RACK SYSTEM

BACKGROUND OF THE INVENTION

1. Field of the Invention

The present invention pertains to the art of dishwashers and, more particularly, to a dishwasher having a side-by-side rack system defining multiple washing zones.

2. Discussion of the Prior Art

In general, dishwashers having multiple dish supports or rack assemblies are known in the art. Particularly, it is known to provide upper and lower rack assemblies, as well as upper, side-by side rack assemblies which are cantilevered from opposing side walls, in a front-loading dishwasher. However, as modern kitchens expand in size, consumers are finding a need for wider dishwashers. With these wider designs, cantilevering a rack assembly off a side wall limits the weight that can be supported at any given time. Moreover, consumers, while also demanding larger capacity dishwashers, desire a more efficient method to wash smaller quantities of dishware.

As kitchens expand in size, the need for space-efficient appliances is rapidly becoming a thing of the past. Kitchen island systems and larger countertops all provide ample space for wider, larger capacity, appliances. In particular, the demand for larger capacity dishwashers is on the rise. The accumulation of breakfast and dinner dishes is typically more than can be accommodated in a single load. In today's fast-paced society, consumers do not have the time to run numerous loads of dishware each day. Additionally, as consumers often need a dishwashing appliance to clean extra load loads resulting from entertaining friends and family. Otherwise, a consumer may be required to run a dishwasher multiple times in order to handle the large quantity of dishware accumulated during a party.

If manufacturers were to gear up to fabricate larger capacity appliances and, in particular, wider dishwashers, they would be faced with the problem of dish support or rack size. Designing racks which are sized to fit into wider units would require retooling production facilities and, with a wider footprint, the size of the production line must be expanded. In many cases, in order to accommodate the larger production lines, new buildings must be constructed. The large capital outlay associated with new production facilities, as well as new production lines is typically more than most manufactures are willing to risk on a new, untested product line.

Finally, in addition to demanding more capacity, energy efficiency is high on the list of consumer priorities. Operating a large capacity dishwasher with only a small load inside is certainly inefficient. Without the ability to control the amount of wash water or focus the water flow to efficiently perform a washing operation, consumers will have to wait to load the dishwasher to its full capacity. While generally not a problem, oftentimes it is necessary to wash only a relatively few dishes at the end of a day. In this case, without the ability to control the wash operation, the consumer may put off washing dishes until enough have accumulated to make operating the dishwasher practical.

Based on the above, there exists a need in the art for a large capacity dishwasher having a wider footprint. More particularly, there exists a need for a large capacity dishwasher having a side-by-side rack system which utilizes both existing dish rack systems arranged alongside a narrower rack system to reduce production costs. Finally, there exists a need for a dishwasher that can selectively direct a washing action to either one, the other or both of the rack systems in order to increase the efficiency of the appliance.

SUMMARY OF THE INVENTION

The present invention is directed to a dishwashing appliance having a side-by-side rack system. More specifically, the dishwashing appliance includes a cabinet shell, a tub defining a washing chamber, and a door assembly pivotally mounted to the cabinet shell for selectively sealing the central cavity. In accordance with a preferred arrangement, slidably supported within the washing chamber are first and second side-by-side dish support racks. In one preferred embodiment, the first rack is a standard 20-inch (50.8-cm) dish rack as used in a standard 24-inch (60.96-cm) wide dishwasher, while the second rack is sized substantially smaller having, for example, a 7-inch (17.78-cm) width. With this arrangement, positioned side-by-side, a 32-inch (81.28-cm) wide dishwasher is formed. In an even more preferable arrangement, the dishwashing appliance includes a first rack system including first and second upper dish support racks positioned over a second rack system having first and second lower dish support racks.

In an effort to increase the support capacity for each of the first and second upper racks, a plurality of upper support elements are arranged within the central cavity. More specifically, each of the upper support elements includes a horizontally extendable outer rack support and an intermediate, horizontally extendable rack support secured to an intermediate support wall. Therefore, a pair of intermediate rack supports are provided to engage with inner portions of the first and second upper racks respectively. With this arrangement, each of the upper racks is not cantilevered off of side portions of the central cavity, but is fully supported along opposing sides thereof. Actually, the intermediate member serves a dual purpose. That is, not only does the intermediate member provide support for the upper racks, it also partially divides the dishwasher into first and second wash zones.

In addition to the upper racks, first and second lower racks are preferably supported through outer lower rack supports extending along inner side walls of the washing chamber and an intermediate lower rack support that extends across the washing chamber from a rear wall to a front edge portion. Actually, a portion of each of the lower rack supports is carried by the door assembly such that the door assembly includes corresponding outer and intermediate rack supports.

Arranged proximate to each of the first and second rack systems is a corresponding spray arm that provides a pressurized spray of washing fluid to perform a washing operation in each of the first and second wash zones. In a preferred arrangement, the first wash zone includes a rotating spray arm positioned beneath each of the upper and lower first racks. Correspondingly, the second wash zone includes a rotating spray arm or wand positioned beneath each of the upper and lower second racks. In the most preferred arrangement, a control can be used to selectively supply pressurized wash fluid to the spray arms associated with each of the first and second wash zones either singly or collectively. In this manner, a consumer can choose to wash dishware loaded in either one or both of the first and second wash zones.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
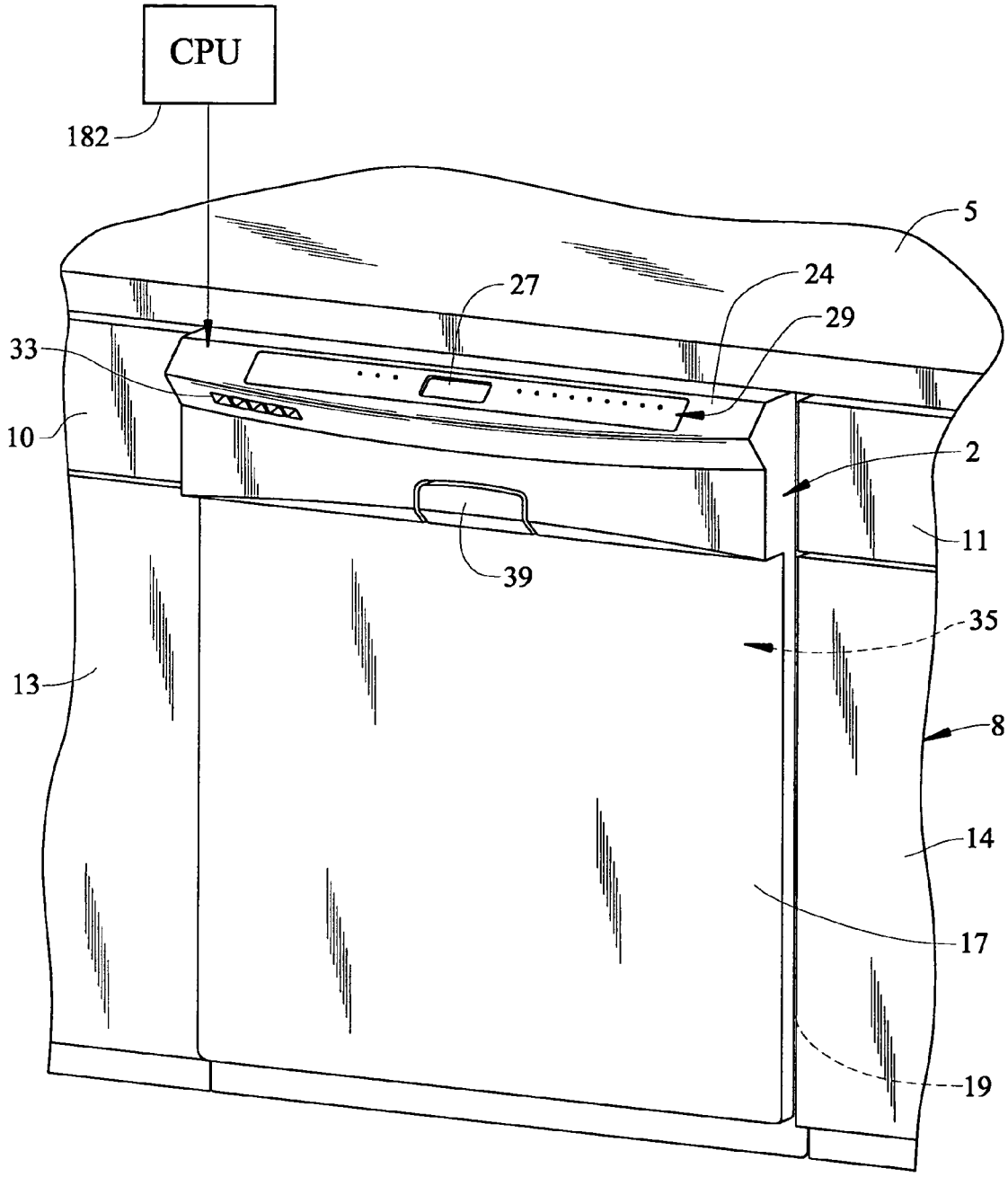
FIG. 1 is a front perspective view of a dishwashing machine incorporating a side-by-side rack system constructed in accordance with the present invention.
Figure 2:
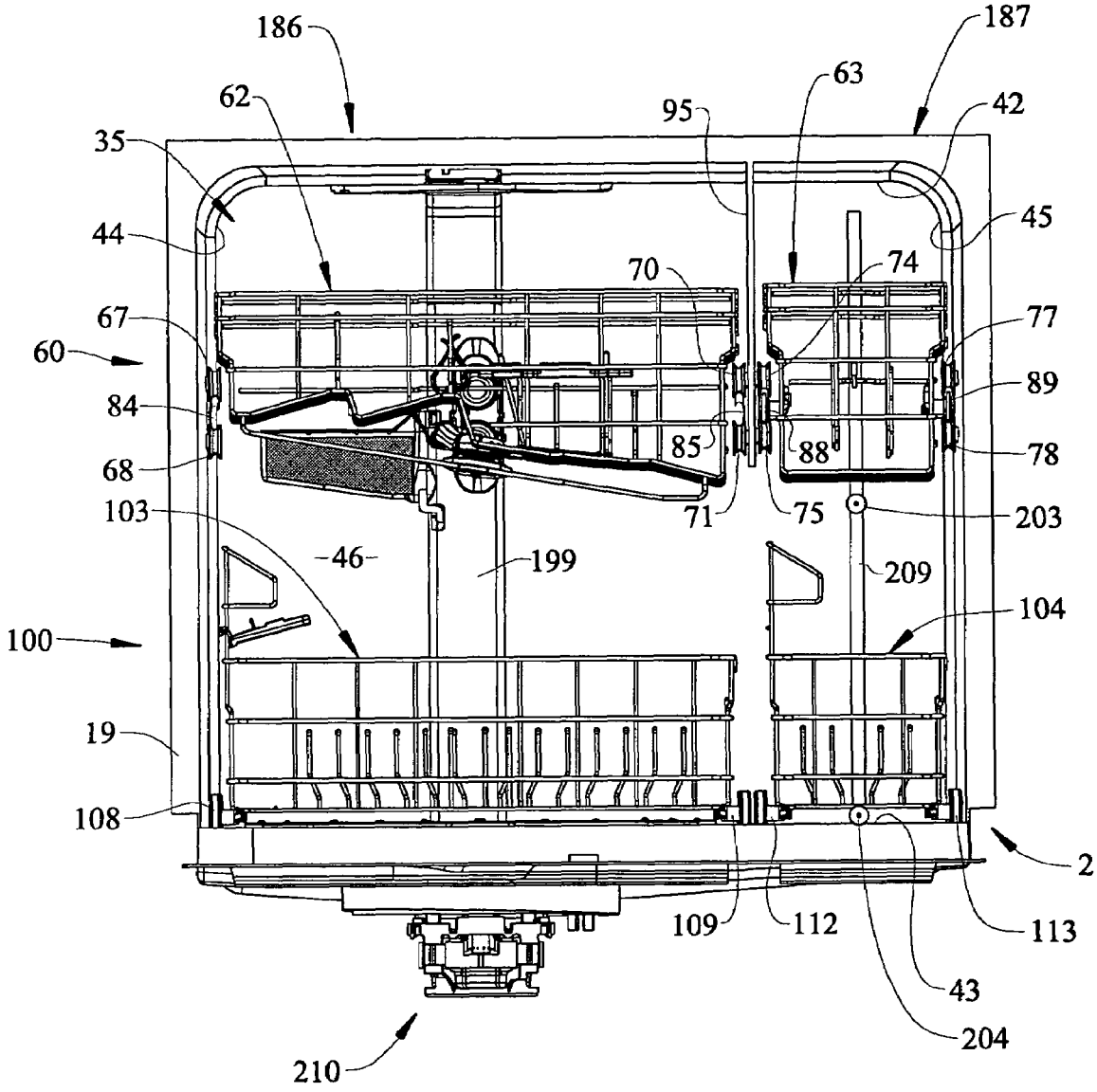
FIG. 2 is a partial front elevational view of the dishwashing machine of FIG. 1, illustrating a preferred arrangement of the side-by-side rack system of the present invention with a door of the dishwashing machine removed.

With initial reference to FIG. 1, a dishwasher 2 is generally indicated to be positioned below a kitchen countertop 5. In accordance with a preferred form of the invention, while standard dishwashers generally are constructed to have approximately a 24-inch (60.96-cm) width, dishwasher 2 is wider, and actually has a width of approximately 32-inches (81.28-cm). Also below kitchen countertop 5 is shown cabinetry 8, including a pair of drawers 10 and 11, and lower cabinet doors 13 and 14. Dishwasher 2 includes a door 17, including an inner panel (not separately labeled), pivotally mounted to a cabinet frame member 19. Dishwasher 2 is also shown to include a control panel portion 24. In the embodiment illustrated, control panel portion 24 includes a display 27, a row of control buttons 29 and a vent zone 33. In general, this overall arrangement of dishwasher 2 and countertop 5 is known in the art wherein dishwasher door 17 is adapted to extend across and close an access opening sealing a tub or washing chamber 35 associated with dishwasher 2, while also being pivotal, such as through a latched handle 39, to a position which enables loading and unloading of dishwasher 2. As shown in FIG. 2, washing chamber 35 includes an upper wall 42, lower wall 43, opposing side walls 44 and 45 and a rear wall 46.

Figure 3:
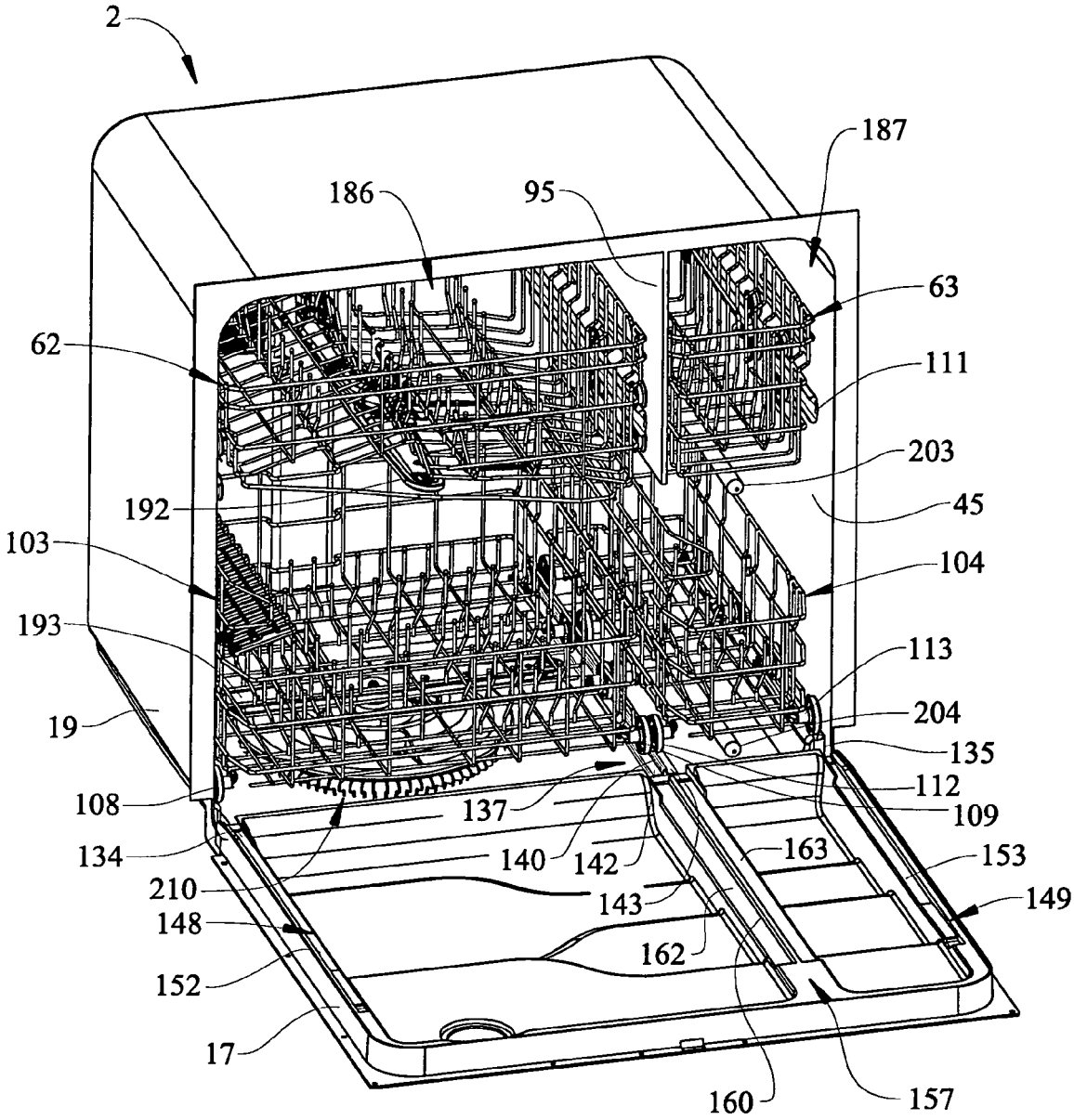
FIG. 3 is an upper left perspective view of the dishwashing machine and side-by-side rack system of FIG. 2.
Figure 4:
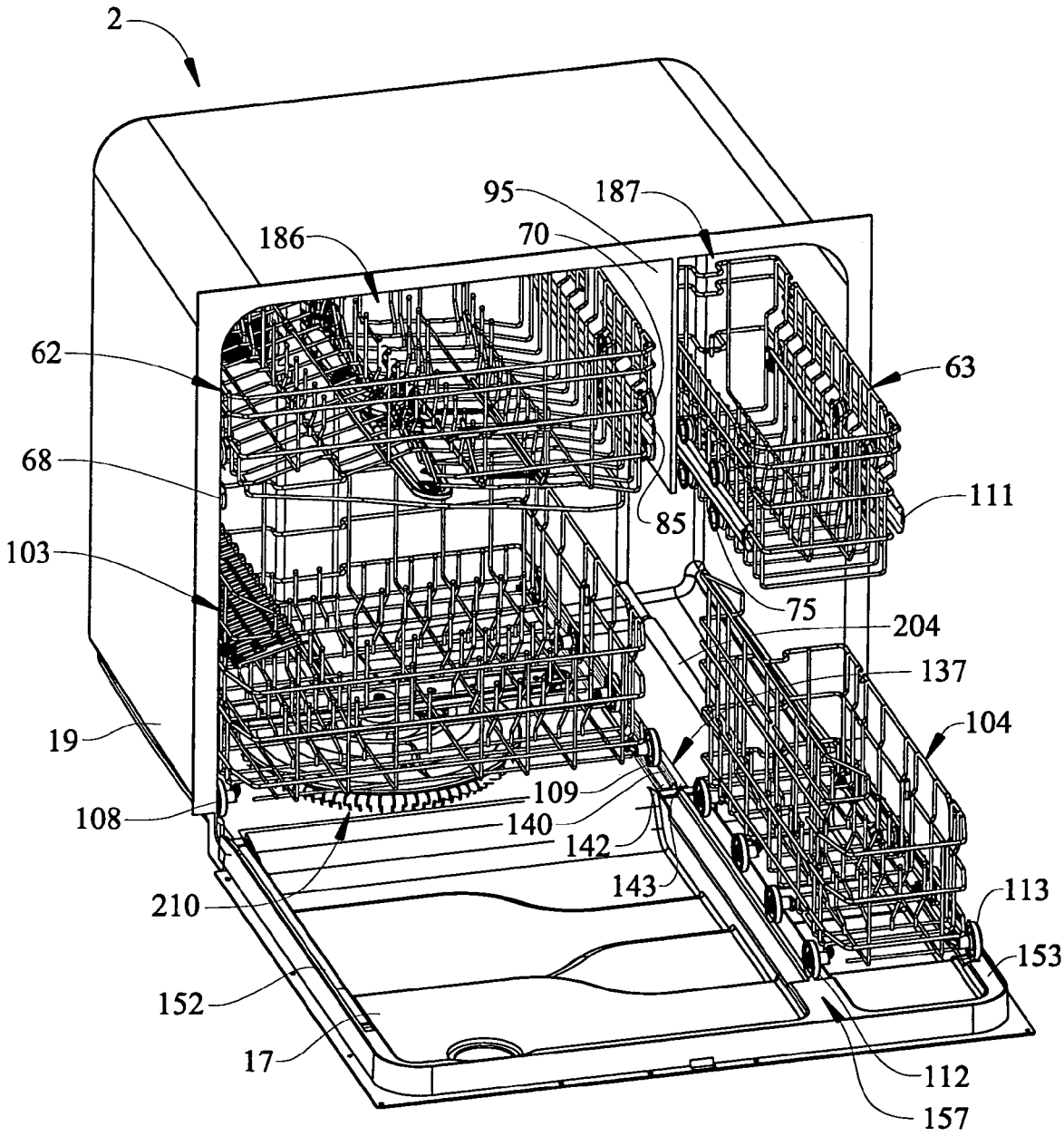
FIG. 4 is an upper left perspective view of the dishwashing machine of FIG. 3 with two of the racks being extended from the dishwasher.

Referring to FIGS. 2–4 depicting a preferred form of the invention, dishwasher 2 includes a first dish support rack system indicated generally at 60. First dish support rack system 60 includes first and second upper racks 62 and 63. First rack 62 preferably has a first width of about 20-inch (50.8-cm) which fits the width of a standard dishwasher, which for example is 24-inches (60.46 cm), and second rack 63 has a second width, substantially narrower than the first dish rack 62, preferably approximately 7-inches (17.78 cm). As shown, each of first and second upper racks 62 and 63 is slidably supported within washing chamber 35. Towards that end, first dish support rack system 60 is provided with upper and lower outer bearing elements or rollers 67 and 68, as well as upper and lower inner bearing elements or rollers 70 and 71 for first upper rack 62. Similarly, first dish support rack system 60 is provided with upper and lower inner bearing elements or rollers 74 and 75, as well as upper and lower outer bearing elements or rollers 77 and 78 for second upper rack 63.

In addition, first dish rack support system 60 is provided with a plurality of horizontally extendable rack support guide rails adapted to be movably supported by bearing elements 67, 68, 70, 71 and 74, 75, 77, 78 carried by first and second upper racks 62 and 63 respectively. More specifically, as best shown in FIG. 2, first upper rack 62 is mounted to an outer rack support and guide rail 84 which extends between bearing elements 67, 68 and to an inner rack support rail 85 arranged between bearing elements 70, 71. In a similar manner, second upper rack 63 carries an inner rack support rail 88 extending between bearing elements 74, 75 to an outer rack support rail 89 arranged between bearing elements 77, 78. Actually, each of bearing elements 70, 71, 74 and 75 is mounted for rotation to an intermediate support structure or wall 95 which extends downward from upper wall 42 and forward from rear wall 46. With this construction, each of first and second upper racks 62, 63 is fully supported within dishwasher 2 for sliding movement into and out of washing chamber 35 for loading and unloading dishware thereupon.

In accordance with the most preferred form of the invention, dishwasher 2 is also provided with a second dish support rack system indicated generally at 100. As shown, second dish support rack system 100 includes first and second lower dish racks 103 and 104 that actually define third and fourth dish racks arranged within dishwasher 2. Each of first and second lower dish racks 103 and 104 is supported by a plurality of bearing elements or rollers which, in the most preferred form of the invention, take the form of wheel assemblies 108 and 109. More specifically, first lower dish rack 103 is provided with a plurality of outer wheel assemblies 108 and inner wheel assemblies 109. Similarly, second lower dish rack 104 includes a plurality of inner wheel assemblies 112 and outer wheel assemblies 113. Of course, it should be understood that each of wheel assemblies 108, 109, 112 and 113 is secured to an associated axle (not labeled) projecting from a respective one of first and second lower racks 103 and 104.

In accordance with the invention, first and second lower racks 103 and 104 glide upon a plurality of lower rack support elements. More specifically, the lower rack support elements are defined by first and second outer rack support guides 134, 135 and an intermediate support guide 137. As best seen in FIGS. 3 and 4, intermediate guide 137 extends from rear wall 46 to a front edge portion of cabinet frame member 19. In the embodiment shown, intermediate guide 137 is provided with an upstanding projecting wall or divider 140 which separates the intermediate guide 137 into first and second glide flats or paths 142 and 143 which provide support for bearing elements 109 and 112 of first and second lower racks 103 and 104 respectively.

Actually, in the most preferred form of the invention, the plurality of lower rack support guides 134, 135 and 137 discontinuously extend onto door 17. As best seen in FIG. 3, arranged upon door 17 are first and second outer rack support guides 148 and 149, each having a respective glide path 152, 153. Also shown in FIG. 3 is an intermediate support guide 157 which, in a manner analogous to intermediate guide 137, includes an upstanding wall or divider 160 separating intermediate support guide 157 into first and second glide flat paths 162 and 163. With this arrangement, first and second lower racks 103 and 104 can be withdrawn from washing chamber 35 and allowed to rest upon door assembly 17 to enable a consumer to load dishware into or remove dishware from dishwasher 2. Furthermore, in accordance with one aspect of the invention, first and second lower support racks 103 and 104 are provided with separate upstanding support structure (not separately labeled) which provide additional support for taller items such as baking pans and the like.

Having described the preferred structure of dishwasher 2, reference will now be made to FIGS. 1–4 in describing a preferred method of operation. Dishwasher 2 is provided with a controller or CPU 182 (FIG. 1) which is adapted to receive inputs through the row of control buttons 29 to establish a particular washing operation. In accordance with the most preferred form of the invention, dishwasher 2 is divided into first and second independently controllable wash zones 186 and 187, as best seen in FIG. 2. That is, first wash zone 186 is constituted by first upper rack 62 and first lower rack 103, and second wash zone 187 is constituted by second upper rack 63 and second lower rack 104.

As best seen in FIG. 3, first wash zone 186 is provided with an upper spray arm 192 positioned below first upper rack 62 and a corresponding lower spray arm 193 arranged below first lower rack 103. In the embodiment illustrated, upper spray arm 193 interconnects to outlet portions (not separately labeled) of a manifold 199. Actually, manifold 199 includes first and second upper outlet portions (not separately labeled) that accommodate a vertical height adjustment for first upper dish rack 62. However, as the actual construction and operation of this height adjustment arrangement does not constitute part of the present invention, it will not be discussed further here, but is set forth in greater detail in commonly assigned U.S. patent application Ser. No. 10/186,739 entitled "Dishwasher Pump and Filtration System" which is incorporated herein by reference.

In a corresponding fashion, second wash zone 187 is provided with a respective upper spray arm 203 and lower spray arm 204 extending from an auxiliary conduit or manifold 209. In further accordance with this form of the invention, upper and lower spray arms 203 and 204 are constituted by rotary wands which provide a pressurized spray directed at upper dish rack 63 and lower dish rack 104 respectively. In any event, pressurized fluid provided by a pump 210 is selectively directed into each of manifolds 199 and 209 to perform a respective washing operation.

In further accordance with the most preferred form of the invention, controller 182 can be selectively set to activate first and second wash zones 186 and 187 either singly or concurrently in order to perform a washing operation. With this construction, a consumer can load dishes into either or both of dish support racks provided in first and second wash zones 186 and 187. In this manner, a consumer can make the most efficient use of dishwasher 2 and, if only a small number of dishes and/or relatively few dishware items require washing, reduce energy consumption by limiting a washing operation to just second wash zone 187.

Although described with reference to a preferred embodiment of the present invention, it should be readily apparent to one of ordinary skill in the art that various changes and/or modifications can be made to the invention without departing from the spirit thereof. For instance, while intermediate support 95 is depicted as a wall, an open structure would also be acceptable. In addition, the dish rack support system could take on various forms such as roller bearings, extensible arms and the like. Also, additional spray arm could be positioned above the upper racks to direct a washing fluid downward onto the dishware. In general, the invention is only intended to be limited to the scope of the following claims.

I claim:

1. A dishwasher comprising:

a tub defining a washing chamber, said tub including at least top and opposing side walls;

a partition wall extending downward from the top wall at a position between the opposing side walls and at least partially dividing the washing chamber into first and second wash zones;

a controller for selectively performing a washing operation in either or both of the first and second wash zones;

a door assembly, spanning each of the first and second wash zones, mounted for movement relative to the tub in order to selectively seal the washing chamber, said door assembly including an inner panel formed with first and second outer guide tracks and an intermediate guide track; and a dish support rack system provided within the washing chamber, said dish support rack system including:

at least one upper dish rack system supported for movement into and out of the tub, said at least one upper dish rack system including first and second upper dish racks movably supported between the partition wall and a respective one of the opposing side walls, said first upper dish rack having a first width and said second upper dish rack having a second width, with the first width being at least double the second width; and at least one lower dish rack system supported for movement into and out of the tub, said at least one lower dish rack system including first and second lower dish racks movably supported between recessed positions, wherein the first and second lower dish racks are arranged within the washing chamber, and extended positions, wherein the first and second lower dish racks are supported upon the intermediate guide track and a respective one of the first and second outer guide tracks.

2. A dishwasher comprising:

a tub defining a washing chamber, said tub including at least top and opposing side walls;

a partition wall extending downward from the top wall at a position between the opposing side walls and at least partially dividing the washing chamber into first and second wash zones;

first and second upper dish racks movably supported between the partition wall and a respective one of the opposing side walls, said first dish rack having a first width and said second dish rack having a second width, with the first width being at least doable the second width;

first and second wash arms positioned adjacent the first and second upper dish racks for selectively delivering washing fluid into the first and second wash zones respectively; and at least one lower dish rack supported for movement into and out of the tub.

3. The dishwasher according to claim 2, wherein the first width is approximately 20-inches (50.8-cm) and the second width is approximately 7-inches (17.78-cm).

4. The dishwasher according to claim 2, wherein the at least one lower dish rack includes third and fourth lower dish racks, said third dish rack being mounted below the first dish rack and having a third width which is substantially equal to the first width, said fourth dish rack being positioned below the second dish rack and substantially in a common plane with the third dish rack, said fourth dish rack having a fourth width which is substantially equal to the second width.

5. The dishwasher according to claim 4, wherein the first, second, third and fourth dish racks are independently slidable relative to the tub.

6. The dishwasher according to claim 4, further comprising: third and fourth wash arms adapted to direct a pressurized flow of wash fluid to the third and fourth dish racks.

7. The dishwasher according to claim 6, wherein at least two of the first, second third and fourth wash arms are constituted by rotating spray arms.

8. The dishwasher according to claim 6, wherein at least two of the first, second, third and fourth wash arms are constituted by rotating wands.

9. The dishwasher according to claim 4, further comprising: first and second wash zones, said first and third dish racks being located in the first wash zone and said second and fourth dish racks being located in the second wash zone, said first and second wash zones being at least defined by the partition.

10. The dishwasher according to claim 9, further comprising: a control system adapted to selectively perform a washing operation in the first wash zone, the second wash zone, or both of the first and second wash zones.

11. A dishwasher comprising:

a tub defining a washing chamber, said tub including at least top, rear and opposing side walls;

a door assembly mounted for movement relative to the tub in order to selectively seal the washing chamber, said door assembly including an inner panel formed with first and second outer guide tracks and a first intermediate guide track;

at least one upper dish rack supported for movement into and out of the tub; and first and second lower dish racks movably supported between recessed positions, wherein the first and second lower dish racks are arranged within the washing chamber, and extended positions, wherein the first and second lower dish racks are supported upon the intermediate guide track and a respective one of the first and second outer guide tracks.

12. The dishwasher according to claim 11, wherein said first lower dish rack has a first width and said second lower dish rack has a second width, with said second width being smaller than the first width.

13. The dishwasher according to claim 12, wherein the first width is approximately 20-inches (50.8-cm) and the second width is approximately 7-inches (17.78-cm).

14. The dishwasher according to claim 11, further comprising: a second intermediate guide track extending from the rear wall of the tub towards said door assembly, said second intermediate guide track being aligned with the first intermediate guide track.

15. The dishwasher according to claim 11, further comprising: a partition wall dividing the washing chamber into first and second wash zones, wherein the first lower dish rack is arranged in the first wash zone and the second lower dish rack is arranged in said second wash zone.

16. The dishwasher according to claim 15, further comprising: a control system adapted to selectively perform a washing operation in either or both of the first and second wash zones.

17. A dishwasher comprising:

a tub defining a washing chamber, said tub including at least top and opposing side walls;

a partition wall extending downward from the top wall of the tub at a position between the opposing side walls and at least partially dividing the washing chamber into first and second wash zones;

a door assembly mounted for movement relative to the tub in order to selectively seal the washing chamber, said door assembly spanning each of the first and second wash zones; and a controller for selectively performing a washing operation in either or both of the first and second wash zones.

18. The dishwasher according to claim 17, further comprising: first and second dish racks slidably supported between the opposing side walls of the tub and the partition wall, said first dish rack having a first width and said second dish rack having a second width, with said second width being smaller than the first width.

19. The dishwasher according to claim 18, further comprising: third and fourth dish racks, slidably supported between the opposing side walls of the tub and an intermediate guide track, said third dish rack having a third width and said fourth dish rack having a fourth width, with said fourth width being smaller than the third width.

20. The dishwasher according to claim 19, wherein the first and second dish racks are mounted above the third and fourth dish racks.

21. The dishwasher according to claim 18, wherein the first width is approximately 20-inches (50.8-cm) and the second width is approximately 7-inches (17.78-cm).

22. The dishwasher according to claim 21, further comprising: a first plurality of wash arms, said first plurality of wash arms being adapted to direct a pressurized flow of wash water into the first wash zone.

23. The dishwasher according to claim 22, further comprising: a second plurality of wash arms, said second plurality of wash earns being adapted to direct a pressurized flow of wash water into the second wash zone.

24. The dishwashing apparatus according to claim 22, further comprising: a control system for establishing an operational mode of the dishwasher, wherein said control system is adapted to selectively operate the first and second plurality of wash arms independently from one another.

25. The dishwasher according to claim 18, wherein the first wash zone is defined by the first and third dish racks, and the second wash zone is defined by the second and fourth dish racks.

* * * * *